US009476189B2

(12) United States Patent
Reimer et al.

(10) Patent No.: US 9,476,189 B2
(45) Date of Patent: Oct. 25, 2016

(54) PUMP STATION

(71) Applicant: XYLEM IP MANAGEMENT S.à.r.l., Senningerberg (LU)

(72) Inventors: Jens Reimer, Täby (SE); Per Porath, Bromma (SE)

(73) Assignee: XYLEM IP MANAGEMENT S.à r.l., Luxembourg (LU)

( * ) Notice: Subject to any disclaimer, the term of this patent is extended or adjusted under 35 U.S.C. 154(b) by 0 days.

(21) Appl. No.: 14/760,645

(22) PCT Filed: Jan. 13, 2014

(86) PCT No.: PCT/IB2014/058217
§ 371 (c)(1),
(2) Date: Jul. 13, 2015

(87) PCT Pub. No.: WO2014/108869
PCT Pub. Date: Jul. 17, 2014

(65) Prior Publication Data

US 2015/0354196 A1 Dec. 10, 2015

(30) Foreign Application Priority Data

Jan. 14, 2013 (SE) ..... 1350040

(51) Int. Cl.
*E03F 5/22* (2006.01)
*F04D 29/60* (2006.01)
(Continued)

(52) U.S. Cl.
CPC ..... *E03C 1/1227* (2013.01); *E03B 5/00* (2013.01); *E03F 5/22* (2013.01); *F04D 29/607* (2013.01)

(58) Field of Classification Search
CPC ..... F04D 29/606; F04D 29/607; E03F 5/22
USPC ..... 417/360
See application file for complete search history.

(56) References Cited

U.S. PATENT DOCUMENTS 3,093,269 A * 6/1963 Messer ..... F04D 29/607 222/333
3,519,072 A * 7/1970 Hilden ..... F04D 29/607 166/66.5

(Continued)

FOREIGN PATENT DOCUMENTS

EP 0034909 9/1981
EP 0611269 8/1994

OTHER PUBLICATIONS

International Preliminary Report on Patentability for International Application No. PCT/IB2014/058217 mailed Jan. 8, 2015.

(Continued)

*Primary Examiner* — Peter J Bertheaud
(74) *Attorney, Agent, or Firm* — RatnerPrestia

(57) ABSTRACT

A pump station includes a tank and a pump unit that is lowerable into the tank. The tank has a bottom and a peripheral wall extending from the bottom, and the peripheral wall has an inlet for incoming liquid flow and an outlet for outgoing liquid flow. The pump unit includes a cross beam and a pump connected to the cross beam. The inside of the wall of the tank presents a set of axially extending guide members, which set includes at least a first guide member arranged to receive and guide a first end of the cross beam and a second guide member arranged to receive and guide a second end of the cross beam.

12 Claims, 3 Drawing Sheets

(51) Int. Cl.
*E03C 1/122* (2006.01)
*E03B 5/00* (2006.01)

(56) References Cited

U.S. PATENT DOCUMENTS 4,403,923 A * 9/1983 Korchin ..... F04D 29/607 417/360
4,416,549 A * 11/1983 Kretschmer ..... A01C 3/026 366/190
4,564,041 A * 1/1986 Kramer ..... F16L 37/26 137/315.01
4,661,047 A 4/1987 Weis
4,679,991 A 7/1987 Harbison
4,886,426 A * 12/1989 Surinak ..... F04D 29/607 285/24
6,644,342 B1 11/2003 Bogan
7,503,339 B1 3/2009 Bogan
7,971,742 B2 * 7/2011 Kreider ..... E03B 7/075 220/23.89

OTHER PUBLICATIONS

International Search Report for International Application No. PCT/IB2014/058217 mailed Apr. 22, 2014.
Written Opinion of the International Searching Authority for International Application No. PCT/IB2014/058217 mailed Apr. 22, 2014.

* cited by examiner

PUMP STATION

CROSS-REFERENCE TO RELATED APPLICATIONS

This patent application is a U.S. National Phase Patent Application of PCT Application No PCT/IB2014/058217, filed Jan. 13, 2014, which claims priority to Swedish Patent Application No. 1350040-0, filed Jan. 14, 2013, each of which is incorporated by reference herein in its entirety.

TECHNICAL FIELD OF THE INVENTION

The present invention relates in general to a pump station for water and waste water. Especially, the present invention relates to a pump station comprising a tank and a pump unit that is lowerable into said tank, the tank comprising a bottom and a peripheral wall extending from the bottom, the wall having an inlet for incoming liquid flow and an outlet for outgoing liquid flow.

BACKGROUND OF THE INVENTION AND PRIOR ART

Pump stations according to the present invention are especially suitable for use in, for instance, water and sewer system installations in which water and waste water from one or more real estates are accumulated in such a pump station and then is pumped further for transport to a sewage treatment plant. It is typical for such pump stations that the tank has quite small diameter which makes service therein cumbersome.

Pump stations of this type comprises a tank and a pump unit that is lowerable into said tank. The pump unit is constituted by a pump, and an outlet pipe extending from said pump, as well as a connection claw arranged at the upper end of the outlet pipe. The connection claw is arranged at a level above the pump. During installation the pump unit is lowered into the tank by having the connection claw guided along guide wires or guide pipes that are mounted in the tank. When correct position is reached the connection claw dock with an outlet connection fixedly arranged in the tank. In order to make the pump station ready for operation, in the end long special tools is inserted into the tank in order to open a valve at the outlet connection.

This type of pump station answers its purpose well, however, problem may arise if the pump of the pump station has stopped to work and thereby is needed to be exchanged. In such cases the waste water rises above the valve of the outlet connection, which thereby may be difficult to locate and maneuver.

Thereto, specific guide wires/guide pipes and specific attachments of these in the tank are needed, which adds costs and complexity to the pump station.

BRIEF DESCRIPTION OF THE OBJECT OF THE INVENTION

The present invention aims at obviating the disadvantages and failings of previously known pump stations and at providing an improved pump station. A primary object of the invention is to provide an improved pump station of initially disclosed type, which entail easy installation of the pump into and easy removal of the pump from the tank of the pump station.

Another object of the present invention is to provide a pump station, in which no post mounted guide means are needed in the tank to guide the pump unit to a required position of operation.

Yet another object of the present invention is to provide a pump station, in which the installation of the pump and removal of the pump is performed by service staff from the ground level without any need for special tools.

BRIEF DESCRIPTION OF THE INVENTION

According to the invention at least the primary object is attained by means of the initially defined pump station having the features of the independent claim. Preferred embodiments of the present invention are further defined in the dependent claims.

According to a first aspect of the present invention a pump station of the initially defined type is provided, which is characterized in that the pump unit comprises a cross beam and a pump connected to said cross beam, and that the inside of the wall of the tank presents a set of axially extending guide members, which set comprises at least a first guide member arranged to receive and guide a first end of the cross beam and a second guide member arranged to receive and guide second end of the cross beam.

Thus, the present invention is based on the understanding that by arranging the guide members in the wall of the tank and having the pump unit comprising a cross beam running along these guide members, no costly post mounted guide means are needed in the tank.

Other advantages with and features of the invention are apparent from the other dependent claims and from the following, detailed description of preferred embodiments.

BRIEF DESCRIPTION OF THE DRAWINGS

A more complete understanding of above mentioned and other features and advantages of the present invention will be apparent from the following, detailed description of preferred embodiments with reference to the attached drawings, in which.

DETAILED DESCRIPTION OF PREFERRED EMBODIMENTS

Figure 1:
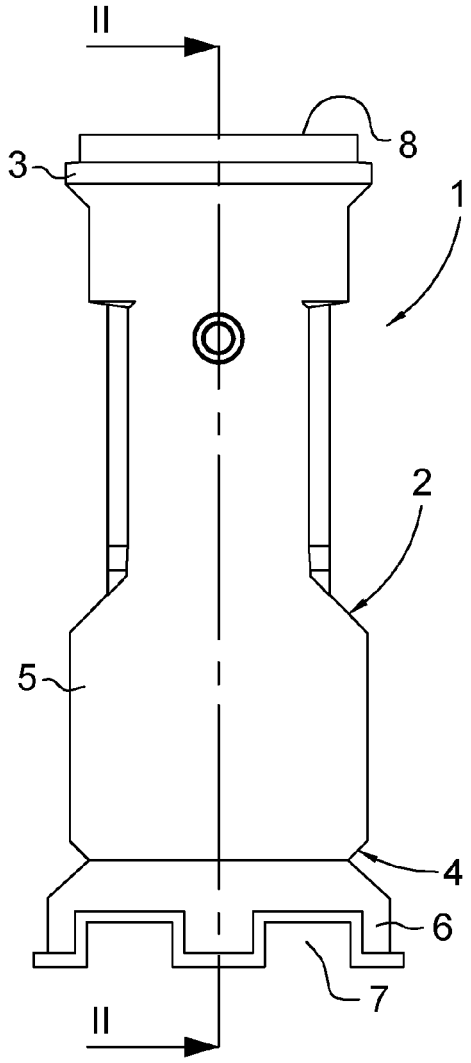
FIG. 1 is a schematic side view of a pump station.

The present invention relates to a pump station, generally designated 1, suitable for water and waste water. Reference is initially made to FIG. 1. An inventive pump station 1 is usually part of water and sewer system installations intended to serve one or more real estates.

Figure 2:
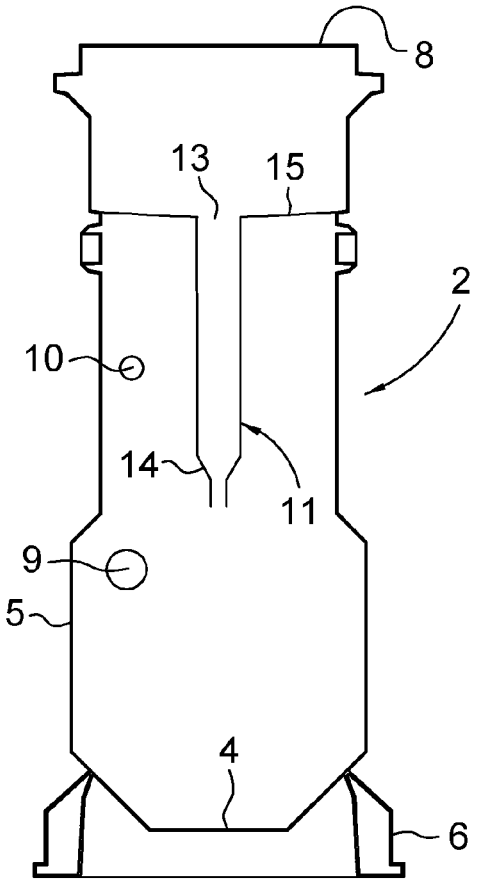
FIG. 2 is a schematic cross sectional side view of the tank of the pump station taken along line in FIG. 1.

The pump station 1 comprises a tank 2 intended to be lowered into the ground at close connection to the real estate to be served, at such a depth that a radially extending collar 3 located in the area of the upper end of the tank 2 is on the same level as the ground surface. The tank 2 comprises a bottom, generally designated 4, and a peripheral wall 5 extending from the bottom 4. In the shown embodiment, see also FIG. 2, the bottom 4 is constituted by a funnel shaped outer section that is inclined downwards to and is attached to a planar center section. However, it shall be pointed out that also other designs of the bottom 4 are possible, for instance the bottom 4 may be constituted by only a planar section, a semispherical section, a funnel shaped section, or a mixture thereof. Furthermore, the tank 2 comprises a foot 6, which is connected to the bottom 4 of the tank 2 and which comprises transverse recesses 7 in order to admit transportation of the tank 2 by means of a fork lift, or the like. The projected footprint of the tank 2 is preferably less than a square having the side 1000 mm, most preferably less than 800 mm. The tank 2 also comprises an inspection opening 8 for access to the inside of the tank 2, which inspection opening 8 is closed by means of a lid (not shown) during normal operation.

The tank 2 also comprises an inlet 9 for incoming liquid flow and an outlet 10 for outgoing liquid flow. In the shown embodiment the inlet 9 mouth in a lower part of the tank 2, which lower part is constituted by the sump of the pump station 1, and the outlet 10 is located in an upper part of the tank 2, which upper part is constituted by a vertically extending shaft extending from the inspection opening 8 to the lower part of the tank 2. Preferably the tank 2 is made by plastic and produced by means of rotational casting, in this way a more or less unitary thickness of material of the tank 2 can be attained without internal material stresses. The wall 5 of the tank 2 may advantageously comprise various transverse and axial stiffeners, which are not disclosed, in order not to be deformed when surrounded by soil/stones.

Figure 3:
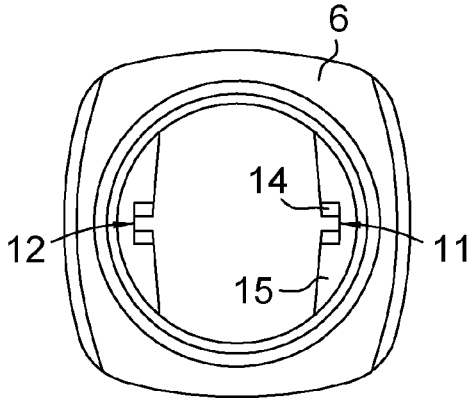
FIG. 3 is a schematic view from above of a tank.

Reference is now also made to FIG. 3. According to the present invention the inside of the wall 5 of the tank 2 present a set of axially extending guide members, which set comprises a first guide member, generally designated 11, and a second guide member, generally designated 12. Preferably the first guide member 11 and the second guide member 12 are opposite each other. The first guide member 11 and the second guide member 12 constitute a part of the wall 5 of the tank 2. In the disclosed, preferred embodiment the first guide member 11 is constituted by a first guide groove and the second guide member 12 is constituted by a second guide groove, wherein the first guide groove and the second guide groove are open radially inwards. In an alternative embodiment the first guide member 11 is constituted by a first guide rail and the second guide member 12 is constituted by a second guide rail, wherein the first guide rail and the second guide rail project radially inwards from the inner side of the wall 5 of the tank 2. It is also feasible that the first guide member 11 is constituted by a guide groove and the second guide member 12 is constituted by a guide rail.

Herein below the first guide member 11 and the second guide member 12 will be described shaped as guide grooves if nothing else is specified. Furthermore the first guide groove 11 and the second guide groove 12 will be described with reference only to the first guide groove 11, and it shall be realized that the corresponding also applies for the second guide groove 12 if nothing else is specified. In the disclosed embodiment the first guide groove 11 is constituted by a radial bulge in the wall 5 of the tank 2, however it shall be pointed out that the guide groove alternatively may be determined by a pair of wall segments projecting radially inwards from the inner side of the wall 5 of the tank 2, or by a recess in the wall 5 of the tank 2.

The first guide groove 11 has an opening 13 in the upper part and a seat 14 in the lower part, and in connection with the upper opening 13 of the first guide groove 11 the wall 5 of the tank 2 preferably presents a guide surface 15 inclined towards the upper opening 13. The guide surface 15 presents preferably an angle in the range 1-20 degrees in relation to a horizontal plane, and the guide surface 15 transcend via a possible chamfer into the guide groove. Preferably the seat 14 is funnel shaped and opens downwards, in order to counteract that solid matter is accumulated in the seat 14. The first guide groove 11 may thereto present converging or stepwise converging shape in the direction from the upper opening 13 to the seat 14.

Figure 4:
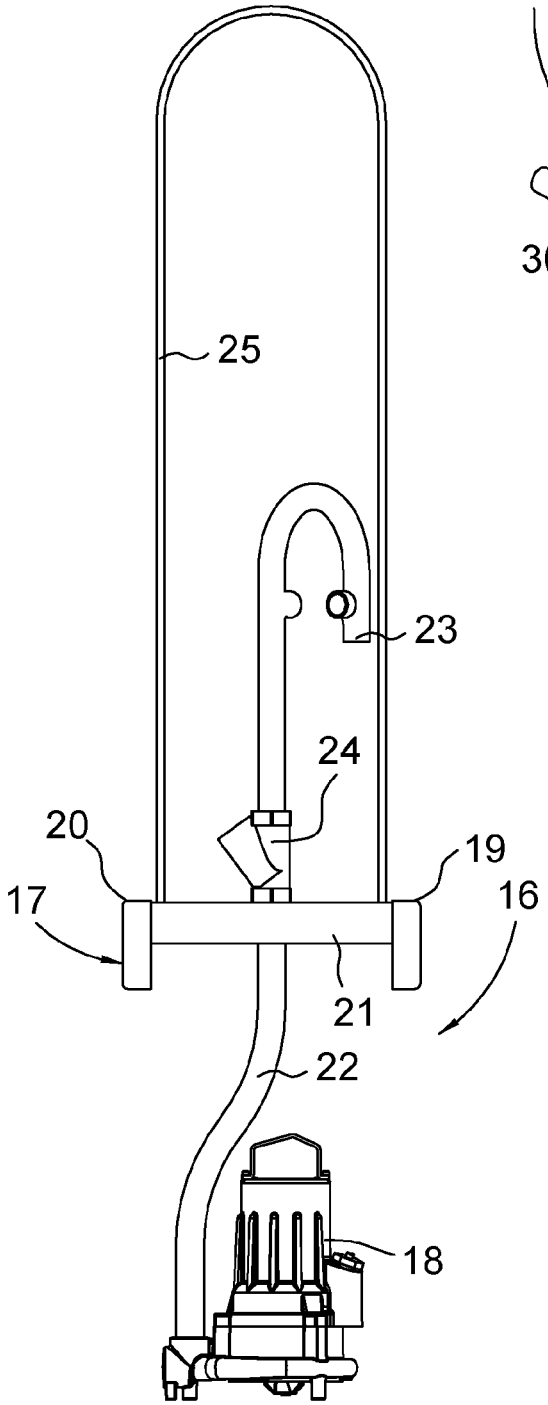
FIG. 4 is a schematic side view of the pump unit of the pump station.

Reference is now also made to FIG. 4, which disclose a pump unit, generally designated 16. The pump unit 16 comprises a cross beam, generally designated 17, and a pump 18 connected to said cross beam 17. The cross beam comprises a first end 19 and a second end 20, wherein the first guide member 11 is arranged to receive and guide said first end 19 and the second guide member 12 is arranged to receive and guide said second end 20. In the disclosed embodiment the cross beam 17 comprises a first guide shoe in the first end 19, and a second guide shoe in the second end 20 as well as an intermediate beam 21, for instance a downwardly open U-beam. Said first guide shoe and said second guide shoe are preferably made by plastic, and the intermediate beam 21 by metal. The first guide shoe and the second guide shoe shall be formed for interaction with the first guide member 11 and the second guide member 12, respectively. In the case the guide member is constituted by a guide groove the guide shoe run in the guide groove and in the case the guide member is constituted by a guide rail the guide shoe present a recess in which the guide rail run. It shall be pointed out that the cross beam 17 in its most elementary embodiment is constituted solely by a beam that is uniform along its longitudinal extension. During lowering of the pump unit 16 into the tank 2 the guide surface 15 guide the first end 19 and the second end 20 of the cross beam 17 to connect to the first guide groove 11 and the second guide groove 12, respectively. It shall be pointed out that the cross beam 17 may be constituted by a cross beam arrangement presenting more than two ends and thereby comprising more than two guide shoes, which interact with correspondingly number of guide members in the tank. Preferably, the inlet 9 mouth at a level below the seat 14 of the first guide member 11, thereby the incoming liquid flow will not flow upon the cross beam 17, and thereto the outlet 10 is preferably located at a level above the seat 14 of the first guide member 11.

In the disclosed embodiment the pump unit 16 comprises an outlet pipe 22 extending between the pump 18 and the cross beam 17, wherein the pump 18 is suspended from the cross beam 17 via the outlet pipe 22. It shall be pointed out that the pump 18, as an alternative or complementary, may be connected to the cross beam 17 in another way than by means of the outlet pipe 22. The outlet pipe 22 is preferably made of metal. The outlet pipe 22 extend further from the cross beam 17 and ends in a free end 23. That part of the outlet pipe 22 located between the cross beam 17 and the free end 23 is according to one embodiment entirely or partly bendable, however it is preferred that this part of the outlet pipe 22 is rigid along the entire length thereof.

Furthermore, it is preferred that the outlet pipe 22 comprises a non-return valve 24, in order to prevent liquid from flowing backwards into the pump station 1 when the pump 18 is not in operation. In the disclosed embodiment the non-return valve 24 is located between the cross beam 17 and the free end 23 of the outlet pipe 22.

In the disclosed, preferred embodiment the pump unit 16 comprises a lifting yoke 25 that is connected to the cross beam 17. The lifting yoke 25 is constituted by a pipe that is shaped like an upside-down U, wherein the shackles of the lifting yoke 25 runs through the cross beam 17. When a lifting force is not acting on the lifting yoke 25 it will be admitted to be displaced downwards in the direction of the pump 18 in order to reduce the total length of the pump unit 16. The shape of the lifting yoke 25 admit that the cross beam 17 may be turned about an axially extending centre axis of the pump unit 16 with great accuracy by means of maneuvering of the lifting yoke 25. The lifting yoke 25 may in an alternative embodiment be exchanged by wire, a chain or the like.

Figure 5:
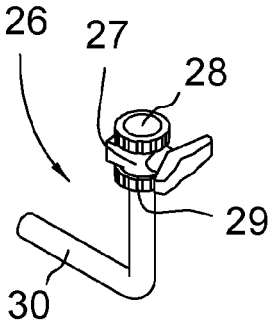
FIG. 5 is a schematic perspective view from above of the outlet connection of the pump station.
Figure 6:
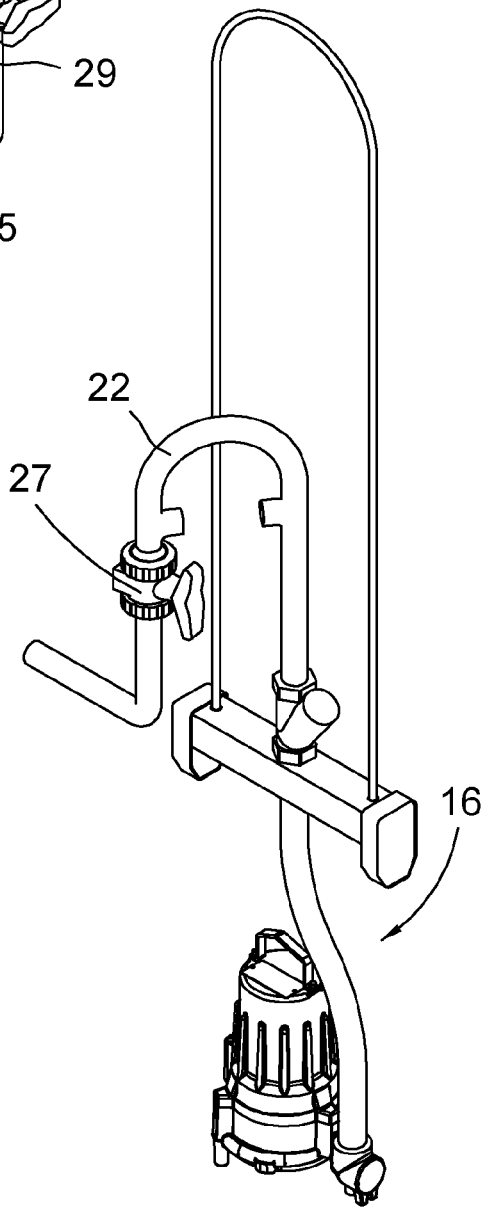
FIG. 6 is a schematic perspective view from above of the pump unit according to FIG. 4 and the outlet connection according to FIG. 5, in a mounted state.
Figure 7:
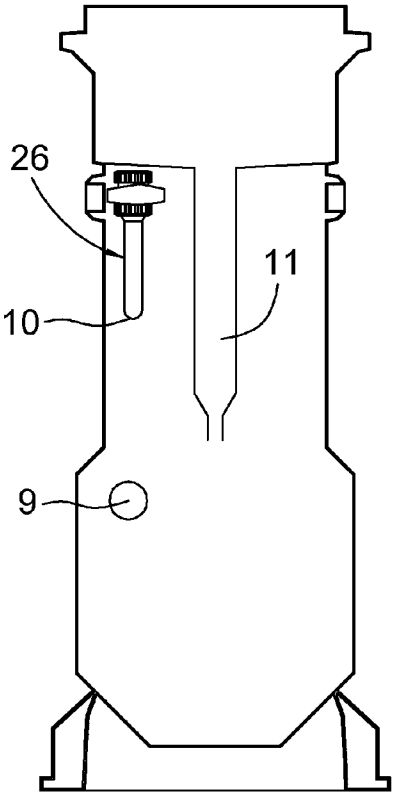
FIG. 7 is a schematic cross sectional side view of the tank of the pump station and the outlet connection according to FIG. 5, in a mounted state.

Reference is now also made to FIGS. 5, 6 and 7. The pump station 1 comprises also an outlet connection, generally designated 26, that is connected to the outlet 10 of the tank 2. The outlet connection 26 comprises a controllable valve 27 having an upstream end 28 and a downstream end 29, and an outlet pipe 30 extending from said downstream end 29. The controllable valve 27 is accessible from ground level via the inspection opening 8. In the shown preferred embodiment the controllable valve 26 is arranged having the upstream end 28 located above the downstream end 29. The pump unit 16 is arranged to be disengageably connected to the outlet connection 26, more precisely the outlet pipe 22 of the pump unit 16 is arranged to be disengageably connected to the outlet connection 26. The free end 23 of the outlet pipe 22 is arranged to be connected to the upstream end 28 of the controllable valve 27 of the outlet connection 26, when the pump unit 16 is in the lowered state. In the shown embodiment the free end 23 of the outlet pipe 22 mouth downwards, and thus the free end 23 of the outlet pipe 22 is lowered down into the controllable valve 27. The controllable valve 27 may for instance be a ball valve, sliding valve, or the like.

Figure 9:
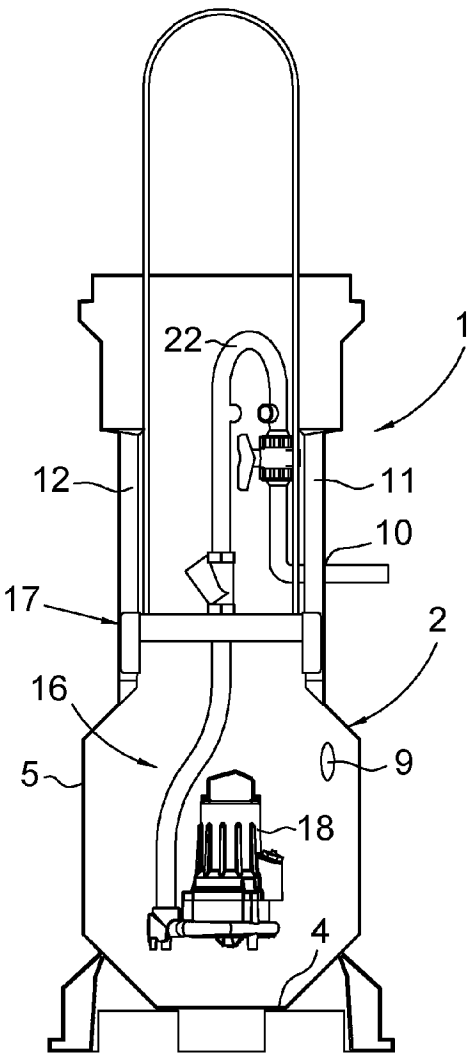
FIG. 9 is a schematic cross sectional side view of an inventive pump station in a mounted state taken perpendicular in relation to FIG. 8.
Figure 8:
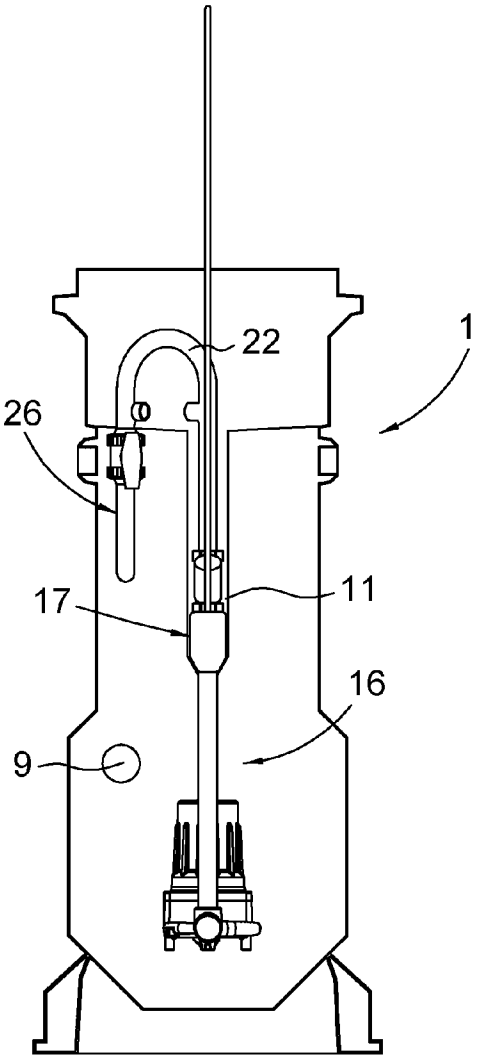
FIG. 8 is a schematic cross sectional side view of an inventive pump station in a mounted state.

Reference is now made to FIGS. 8 and 9, in which the pump unit 16 is lowered into the tank 2, by having the first end 18 of the cross beam 17 running along the first guide member 11 and by having the second end 19 of the cross beam 17 running along the second guide member 12. When the cross beam 17 of the pump unit 16 engage the seat 14 of the first guide member 11 and the corresponding seat of the second guide member 12, the pump 18 is positioned at a predetermined level in relation to the bottom 4 of the tank 2, and the pump unit 16 has taken an operative position. Thereto the free end 23 of the outlet pipe 22 is positioned in order to be connected to the controllable valve 27 of the outlet connection 26. In the preferred embodiment the connection between the free end 23 of the outlet pipe 22 and the controllable valve 27 is constituted by pipe connection or a bayonet connection. In an alternative, not shown, embodiment the connection is of telescopic type, in which the free end 23 of the outlet pipe 22 is lowered into a pipe socket/funnel that is connected to the upstream end 28 of the controllable valve 27 and in which a seal is arranged at their mutual interface. It shall be pointed out that the controllable valve 27 may be constituted by a non-return valve that is effected by and opened when the free end 23 of the outlet pipe 22 engage telescopically with the outlet connection 26.

In an alternative, not shown, embodiment the free end 23 of the outlet pipe 22 is arranged on a short, axially extending pipe segment that is connected to the cross beam 17 and that project in the downward direction. In one embodiment the cross beam 17 present an inner cavity that constitute a part of the outlet pipe 22, more precisely the outlet pipe 22 extends from the pump 18 to the inner cavity of the cross beam 17 and further via above mentioned pipe segment to the free end 23. When the pump unit 16 is lowered and takes the operative position, above mentioned pipe segment is connected telescopically with the outlet connection 26.

Thereto, the cross beam 17, or any other suitable part of the pump unit 16, may in connection with the pump unit 16 reaching the operative position automatically effect the controllable valve 27 in such a way that it is opened.

It shall be pointed out that the pump station 1 may comprise a number of pump units 16 that are lowered into the tank 2 next to each other. It is also conceivable that a pump unit may comprise several pumps and/or several cross beams. In the case several pumps are located in the tank a common outlet connection or separate outlet connections may be used.

It shall also be pointed out that the shaft/upper part of the tank 2 may be extended by means of an extension (not shown) that is lowered telescopically into the inspection opening 8. In those cases an extension is used the first guide member 11 and the second guide member 12 may also extend along the inner side of the extension. It shall also be pointed out that when an extension is used it is also preferable to extend the outlet connection 26 upwards such that the controllable valve 27 is accessible from the upper opening of the extension.

FEASIBLE MODIFICATIONS OF THE INVENTION

The invention is not limited only to the embodiments described above and shown in the drawings, which primarily have an illustrative and exemplifying purpose. This patent application is intended to cover all adjustments and variants of the preferred embodiments described herein, thus the present invention is defined by the wording of the appended claims and thus the equipment may be modified in all kinds of ways within the scope of the appended claims.

It shall also be pointed out that all information about/concerning terms such as above, under, upper, lower, etc., shall be interpreted/read having the equipment oriented according to the figures, having the drawings oriented such that the references can be properly read. Thus, such terms only indicates mutual relations in the shown embodiments, which relations may be changed if the inventive equipment is provided with another structure/design.

It shall also be pointed out that even thus it is not explicitly stated that features from a specific embodiment may be combined with features from another embodiment, the combination shall be considered obvious, if the combination is possible.

The invention claimed is:

1. A pump station for water and waste water, comprising a tank and a pump unit that is lowerable into said tank, the tank comprising a bottom and a peripheral wall extending from the bottom, the wall having an inlet for incoming liquid flow and an outlet for outgoing liquid flow, wherein the pump unit comprises a cross beam and a pump connected to said cross beam, and that the inside of the peripheral wall of the tank includes a set of axially extending guide members, said set of axially extending guide members comprising at least a first guide member arranged to receive and guide a first end of the cross beam and a second guide member arranged to receive and guide a second end of the cross beam.

2. The pump station according to claim 1, wherein the first guide member and the second guide member are opposite each other.

3. The pump station according to claim 1, wherein the first guide member comprises a first guide groove, and the second guide member comprises a second guide groove.

4. The pump station according to claim 3, wherein each of said first guide groove and said second guide groove comprises a seat that is open upwards.

5. The pump station according claim 1, wherein the pump station comprises an outlet connection that is connected to the outlet of the tank.

6. The pump station according to claim 5, wherein the outlet connection comprises a controllable valve having an upstream end and a downstream end, and an outlet pipe extending from said downstream end.

7. The pump station according to claim 6, wherein the upstream end of the controllable valve is arranged above the downstream end of the controllable valve.

8. The pump station according to claim 5, wherein the pump unit is arranged to be disengageably connected to the outlet connection.

9. The pump station according to claim 8, wherein the pump unit comprises an outlet pipe that is connected to the pump and that is arranged to be disengageably connected to the outlet connection.

10. The pump station according to claim 9, wherein the outlet pipe of the pump unit is connected to the cross beam.

11. The pump station according to claim 9, wherein the outlet pipe comprises a nonreturn valve.

12. The pump station according to claim 1, wherein the tank is made of plastic.

* * * * *